US006840167B2

(12) United States Patent
Clark et al.

(10) Patent No.: US 6,840,167 B2
(45) Date of Patent: Jan. 11, 2005

(54) MULTI-COLOR PAD PRINTING APPARATUS AND METHOD

(76) Inventors: Lloyd Douglas Clark, 15 Conrad St., San Francisco, CA (US) 94131-2924; Brian A. Brown, 325 Lake St., San Francisco, CA (US) 94118-1320

( * ) Notice: Subject to any disclaimer, the term of this patent is extended or adjusted under 35 U.S.C. 154(b) by 0 days.

(21) Appl. No.: 10/341,662

(22) Filed: Jan. 13, 2003

(65) Prior Publication Data

US 2003/0136281 A1 Jul. 24, 2003

Related U.S. Application Data

(60) Provisional application No. 60/352,091, filed on Jan. 24, 2002.

(51) Int. Cl.[7] ..... B41F 17/00; B41F 31/00

(52) U.S. Cl. ..... 101/41; 101/35; 101/42; 101/44; 101/327; 101/DIG. 40

(58) Field of Search ..... 101/41, 42, 44, 101/35, 327, DIG. 40

(56) References Cited

U.S. PATENT DOCUMENTS

| | | | | |
|---|---|---|---|---|
| 4,365,554 A | * | 12/1982 | Siegal et al. | 101/333 |
| 4,723,485 A | | 2/1988 | Berberich et al. | |
| 4,745,857 A | | 5/1988 | Putnam et al. | |
| 4,833,486 A | | 5/1989 | Zerillo | |
| 5,555,813 A | | 9/1996 | Hale et al. | |
| 5,590,600 A | | 1/1997 | Hale et al. | |
| 5,644,988 A | | 7/1997 | Xu et al. | |
| 5,694,847 A | * | 12/1997 | Kleist | 101/170 |
| 5,698,018 A | | 12/1997 | Bishop et al. | |
| 5,699,303 A | * | 12/1997 | Hamamoto et al. | 365/189.09 |
| 5,943,067 A | | 8/1999 | Kong | |
| 6,035,777 A | | 3/2000 | King | |
| 6,123,021 A | | 9/2000 | Cameron | |
| 6,244,172 B1 | * | 6/2001 | Holmberg et al. | 101/41 |
| 6,276,266 B1 | | 8/2001 | Dietz et al. | |

FOREIGN PATENT DOCUMENTS

EP 0 802 051 A1 10/1997

* cited by examiner

*Primary Examiner*—Andrew H. Hirshfeld
*Assistant Examiner*—Marvin P Crenshaw

(57) ABSTRACT

A system for color printing in an economical, simple, yet accurate manner comprises a computer (200) which causes an inkjet printer (210) to print a multi-color image of ink (215) on the surface (302) of a pad (300). The pad is made of silicone rubber and is supported in a frame (305). The rubber is either insulating or conductive, as required. Its surface can be smooth or textured. The pad is normally flat during application of the ink image. The pad can be used flat, or it can be deformed into a convex shape after the ink image is applied. The pad is then applied to a receiving object (400), transferring the ink image (216) to the object. Deformation of the pad is accomplished using a ram (410), or hydraulic or pneumatic pressure. Since the printed pad (300) contains all colors to be printed, a full-color image is transferred in a single operation of the pad.

28 Claims, 5 Drawing Sheets

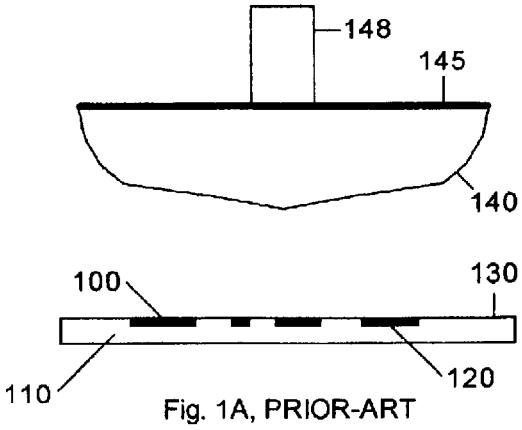
Fig. 1A, PRIOR-ART
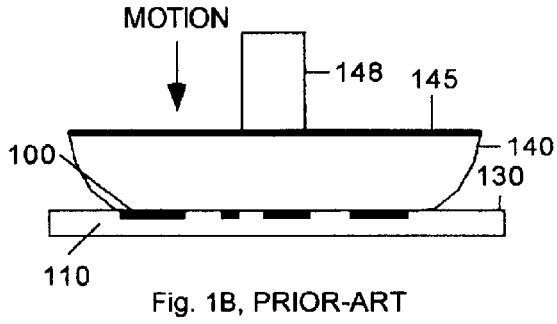
Fig. 1B, PRIOR-ART
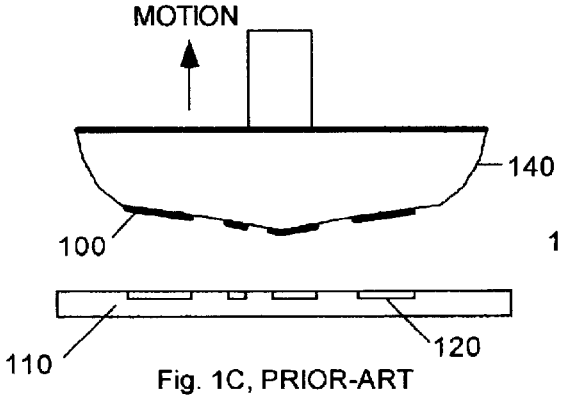
Fig. 1C, PRIOR-ART
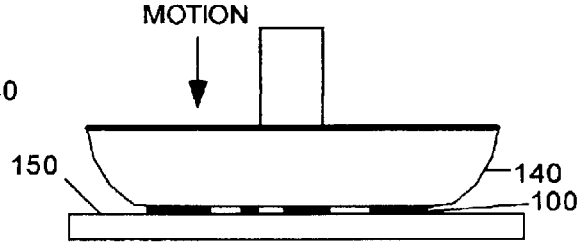
Fig. 1D, PRIOR-ART
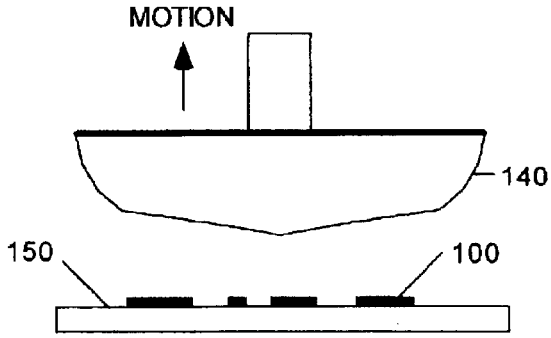
Fig. 1E, PRIOR-ART

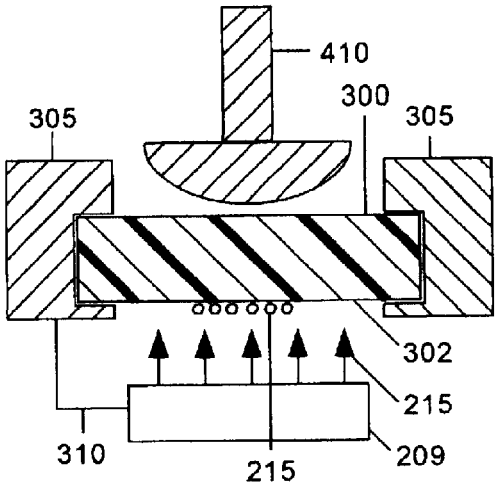
Fig. 3
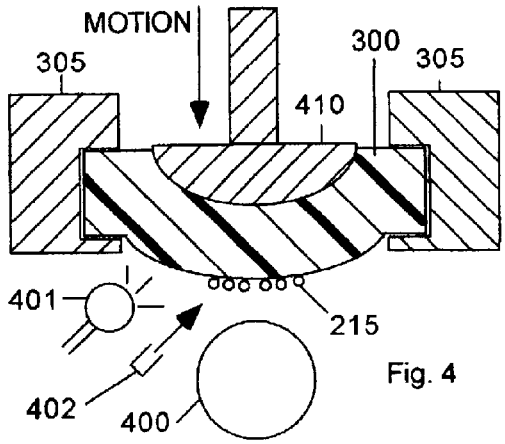
Fig. 4
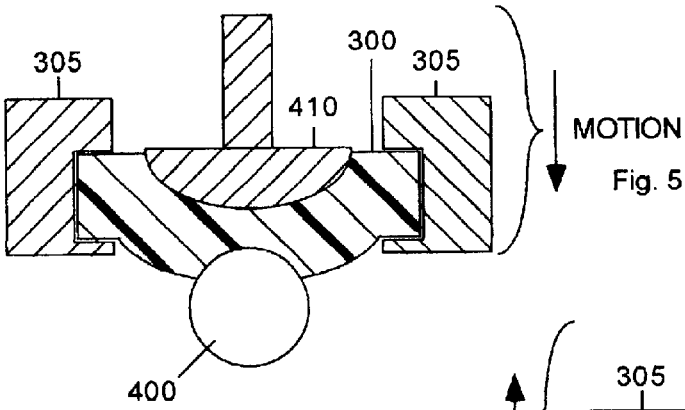
Fig. 5
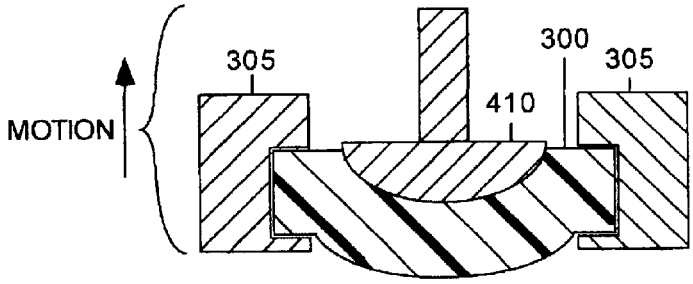
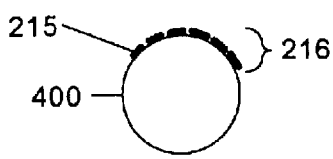
Fig. 6
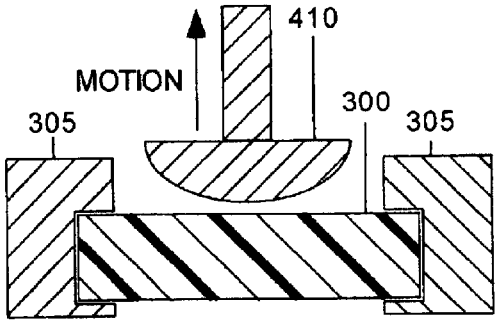
Fig. 7

MULTI-COLOR PAD PRINTING APPARATUS AND METHOD

CROSS-REFERENCE TO RELATED APPLICATIONS

This application claims priority of provisional patent application, Ser. No. 60/352,091, filed Jan. 24, 2002.

FEDERALLY SPONSORED RESEARCH

None

SEQUENCE LISTING

None

BACKGROUND

1. Field of Invention

This invention relates generally to pad printing, and in particular to transferring multi-color images.

2. Prior-Art—Pad Printing—FIGS. 1A–1E

Image transfer through pad printing is an old and well-established art. It is a type of offset printing that is used to apply markings and images to a variety of flat, curved, and irregular surfaces, including watch faces, golf balls, and bottles. The steps in prior-art pad printing are shown in cross-section in FIGS. 1A through 1E.

FIG. 1A shows a cross-sectional view of a prior-art pad 140 suspended over cliché 110 after cliché 110 has been inked. A cliché is a stereotype or printing plate which is etched in a pattern to be printed and which is inked. Ink 100 is doctored into image-shaped depressions 120 in cliché 110, in well-known fashion. The flat surface 130 of cliché 110 is scraped clean during the process of doctoring ink 100 into depressions 120. Pad 140 later lifts the ink from the cliché and applies it to the final receiving surface (not shown).

FIG. 1B shows a cross-sectional view of pad 140 in contact with surface 130 of cliché 110 and ink 120. A soft, typically conical, flexible rubber pad 140 is affixed to a rigid plate 145. Plate 145 is rigidly attached to shaft 148. Shaft 148 is connected to a ram (not shown) which moves shaft 148, plate 145, and pad 140 up and down. To pick up ink 100, pad 140 is pressed against cliché 110 with adequate force, between 0.2 and 50 kilograms, to deform pad 140, fully spanning all inked areas. The surface of pad 140 is thereby wetted with ink 100 in the pattern of the image to be printed.

FIG. 1C shows a cross-sectional view of pad 140 with ink 100 which has been removed from cliché 110. Pad 140 is next lifted away from cliché 110. Ink 100 adheres preferentially to pad 140, and is removed from depressions 120.

FIG. 1D shows a cross-sectional view of pad 140, ink 100, and image-receiving surface 150. Pad 140 is next forcibly pressed against a new receiving surface 150 which may be a flat, curved, or irregular object. During this pressing, pad 140 is deformed to the same extent as shown in FIG. 1B. By deforming pad 140 to the same extent as shown in FIG. 1B, an ink pattern identical to the original image-wise pattern of ink-containing depressions 120 is recreated on surface 150.

FIG. 1E shows the final printing step in which pad 140 is removed from surface 150, leaving ink 100 behind. Pad 140 is next lifted away from receiving surface 150. As pad 140 is lifted away, ink 100 leaves the surface of pad 140 and adheres to receiving surface 150. An ink replica of the original image in cliché 110 is thus transferred from cliché 110 to receiving surface 150.

Pad 140 is typically between 5 mm and 20 cm in diameter, and between 5 mm and 10 cm in height. Depressions 120 can be any shape and are typically between 0.25 mm and 5 mm in extent, and 0.025 mm deep.

Although a flat receiving surface 150 is shown, other shapes are possible. Images can as easily be transferred to curved and irregular surfaces.

The preparation of cliché 110 involves well-known photographic processing and etching or dissolving away of the pattern of depressions 120. Each cliché is used to print one color at a time.

Printing of multi-color images requires preparation of more than one cliché. An image composed of two different component colors requires the preparation of two clichés. Three-color images require the preparation of three clichés, and so forth. Full-color, process printing involves the preparation of three or four clichés, one each for cyan, magenta, yellow, and optionally, black. Separation, exposing, and etching of the clichés is time-consuming and expensive.

Printing of multi-color images further requires precise registration of the printed images. This means that the pad must be precisely positioned over the first inked cliché, then again precisely positioned over the receiving surface. Then, the pad must be precisely positioned over the second inked cliché, and again precisely positioned over the receiving surface, and so on. The precision required to obtain visually acceptable images places very stringent requirements on the skill of the operator in preparing the clichés, and in operation and tolerances of the equipment which transfers the ink from the plates to the final receiving surface. These operations require significant expenditures of time and labor.

When any of the steps above contain positional and other errors, these errors can result in improper registration and alignment of the multiple colors and hence failed prints which must be discarded. This results in extra costs to the manufacturer and wasted materials, time, and money. In addition, making one or more clichés for each print costs time and money.

OBJECTS AND ADVANTAGES

Accordingly, several objects and advantages of the present invention are to provide an improved pad printing system which can print monochrome and polychrome images without multiple transfer operations, to provide an improved pad printing system in which the component cyan, magenta, yellow, and black (or other printing colors) are precisely registered without operator intervention, to reduce the amount of time and labor required to print these images, to reduce the amount of wastage caused by misregistration of the printing colors, and to introduce a novel method, apparatus, and system for pad printing which does not employ a cliché. Other objects and advantages are to provide a system in which pad printing can be easily accomplished using a standard computer and printer, and a pad which contains all the colors to be printed, all in a single stroke.

Additional objects and advantages will become apparent from a consideration of the drawings and ensuing description thereof.

SUMMARY

In accordance with the present invention, a method, apparatus, and system are provided for producing low-cost, partial, or full-color pad-printed images. All colors contained in an image are first printed directly onto the pad by an inkjet or other printer to form a mirror image of the final desired image. Then all colors are simultaneously transferred from the pad to the final receiving surface with a single transfer stroke.

BRIEF DESCRIPTION OF THE DRAWINGS

FIGS. 1A through 1E are cross-sectional views of a prior-art pad printing process.

FIGS. 3 through 7 show the steps in printing an image onto a pad and transferring the image to the surface of a receiving object.

DRAWING FIGURE REFERENCE NUMERALS

| | |
|---|---|
| 100 | Ink |
| 110 | Cliché |
| 120 | Depression |
| 130 | Surface |
| 140 | Pad |
| 145 | Plate |
| 148 | Shaft |
| 150 | Receiving surface |
| 200 | Computer |
| 205 | Optional printer types |
| 208 | Inkjet printer electronics |
| 209 | Inkjet print head |
| 210 | Printer |
| 215 | Ink droplets |
| 216 | Image |
| 220 | Cable |
| 300 | Pad |
| 302 | Pad surface |
| 305 | Frame |
| 310 | Wire |
| 400 | Object being printed |
| 401 | Illumination source |
| 402 | Heat, cold, gas, humidity source |
| 410 | Ram |
| 800 | Alternative frame |
| 810 | Fluid |
| 820 | Port |
| 1000 | Radioactive source |
| 1005 | Radiation |
| 1010 | Plasma source |
| 1015 | Plasma |
| 1100 | Alternative frame |

DETAILED DESCRIPTION

Figure 2:
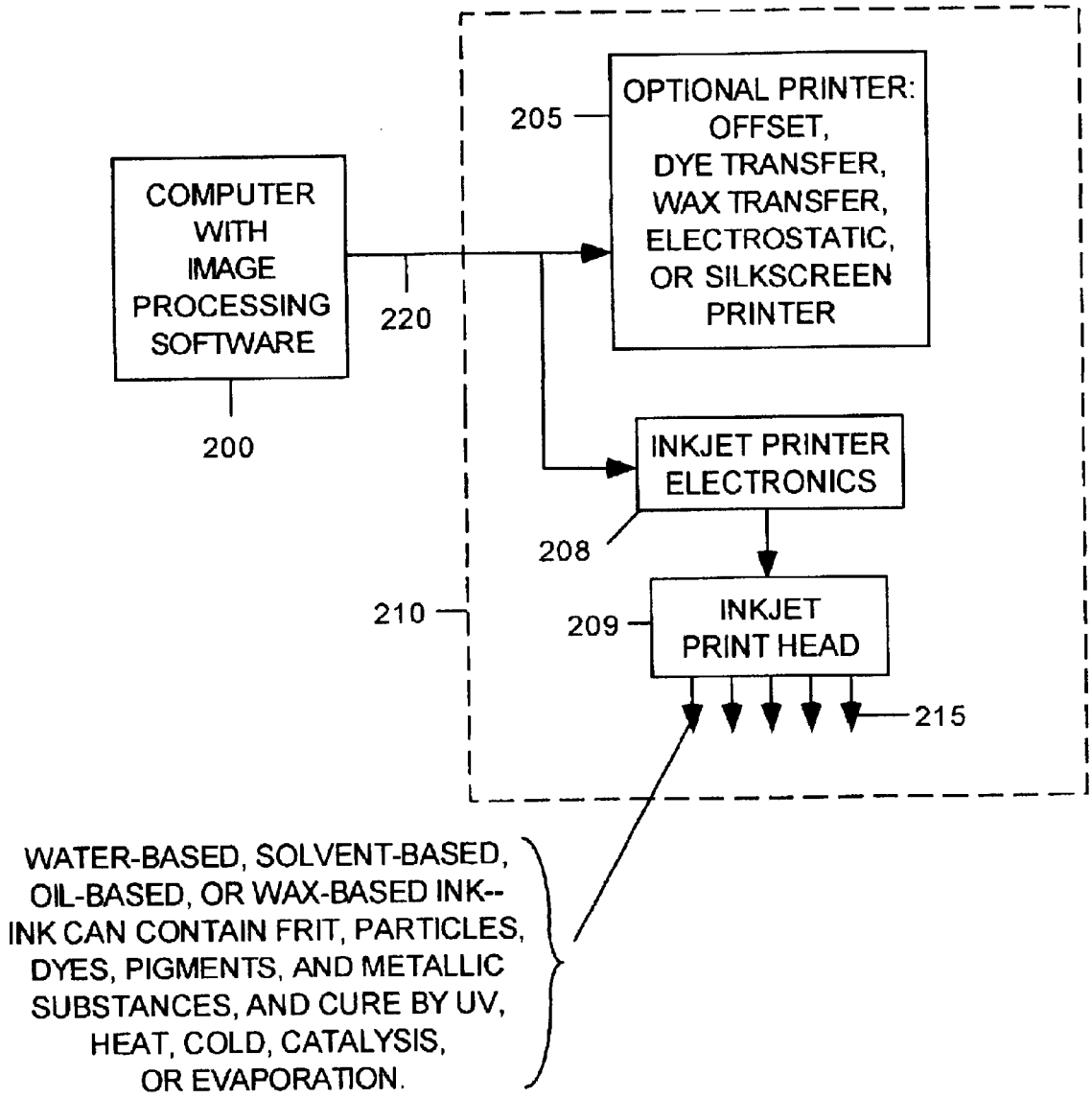
FIG. 2 shows a computer and inkjet printer used in the system of the present invention.

Preferred Embodiment—FIGS. 2 Through 4.

In accordance with a preferred embodiment of the invention, an image for a pad preferably is prepared using a standard, personal computer 200 (FIG. 2) with image processing software. A widely-used software program which can prepare images is sold under the trademark Photoshop, by Adobe Systems Inc., of San Jose, Calif., USA. Suitable original images can be obtained from photographs, computer-generated artwork, and the like. A software program which can prepare computer-generated artwork is sold under the mark Illustrator, also by Adobe Systems Inc.

Computer 200 is connected to a printer 210 by a cable 220. Printer 210 can optionally be an electrostatic, offset, dye transfer, wax transfer, inkjet, or any other type of printer. The preferred embodiment employs an inkjet printer. Inkjet printer electronics 208 cause inkjet print head 209 to emit ink droplets 215, which can be monochrome or of multiple colors. Head 209 can be operated in any orientation. The spacing between head 209 and the surface on which ink droplets 215 are deposited is critical. In general, this spacing must be less than 1 or 2 mm. Printer driver software (not shown but well known) provides communication between the image processing software in computer 200 and printer 210, in well-known fashion. One such print head suitable for use in this application is the model SL-128 manufactured by Spectra, Inc., of Lebanon, N.H., U.S.A. Inks suitable for this application are manufactured by Hilord Chemical Corporation, of Hauppauge, N.Y., U.S.A.

Many inks are suitable for use in the present invention. These include water, solvent, oil, and wax-based inks. These inks can contain frit, particles, metals, magnetic substances, dyes, and pigments. The inks can be cured by infrared or ultraviolet light, visible light, microwaves, heat, cold, catalyst, or evaporation.

Inkjet print head 209 is used with a flexible pad 300 and a ram 410, as shown in FIG. 3. Pad 300 is flexible and is shown in cross-section. It is preferably made of a silicone rubber elastomer and is nominally 10 cm on a side and 1.5 cm thick. Surface 302 of pad 300 may be smooth or textured. Typical texture or roughness factors using the standard, well-known Sheffield scale, can range from below 10 on the smooth end to more than 300 on the rough end. Pad 300 is held in place by a frame 305. Print head 209 is positioned beneath surface 302 of pad 300, having been moved to this position by a known mechanism (not shown). In the case of an inkjet printer, because of the requirement for close spacing (discussed above) between inkjet head 209 and the surface receiving droplets 215, it is generally advantageous to print onto a flat surface. Maintaining close spacing between head 209 and surface 302 would be very difficult and the trajectory of head 209 would have to be adjusted for each pad if surface 302 were not flat. Therefore pad 300 has a normally flat surface facing head 209. Since pad 300 is flat, a simple print head transporting mechanism (not shown) which operates in a line or plane can be used. Print head 209 is arranged to spray a monochrome or polychrome image comprising droplets of ink 215 onto surface 302 of pad 300 under the command of computer 200 (FIG. 2).

Special care must be given to the material from which pad 300 is made. Prior-art pads in use today are generally made of cast silicone rubber, such as part number TSE3457T, manufactured by the General Electric Company, of Fairfield, Conn., U.S.A. This prior-art material is normally electrically insulating. Because of the small size of droplets 215 associated with inkjet printing, static electricity buildup on surface 302 of pad 300 can cause droplets 215 to deviate from their intended trajectory. This causes undesirable blurring of the image and unintended mixing of colors on the pad.

Therefore, in the present system pad 300 in the preferred embodiment is made of part number CRTV5120, a conductive silicone rubber, also manufactured by the General Electric Company. This rubber compound has a conductivity between 200 and 800 ohm-cm, and durometer hardness of about 35–40. Using this conductive rubber under the conditions described below, buildup of static electricity is eliminated.

Frame 305 is preferably made of a metallic conductor and is in electrical contact with conductive pad 300. Frame 305 is electrically connected to head 209 by a wire 310 so that pad 300, frame 305, and head 209 are held at the same electrical potential. With all three elements at the same electrical potential, there is no electric field between head 209 and surface 302 of pad 300. The absence of an electric field in the region between pad surface 302 and head 209 prevents misdirection of ink droplets 215 due to static electric charge buildup on surface 302 of pad 300. Ram 410, not currently in contact with pad 300, is later used to deform pad 300.

Once the image comprising ink droplets 215 (monochrome or colored) is complete on surface 302 of pad 300, print head 209 is moved away and pad 300 is positioned over a receiving object 400, such as a golf ball, as shown in FIG. 4. The image comprising droplets 215 is now ready to be transferred to object 400. In pad printing, ink 215 is normally transferred from a convex-shaped pad to the final receiving surface. This prevents the unwanted spread of ink 215 due to trapping of air between pad surface 302 and object 400. Thus ram 410 is arranged to exert force against the back side of pad 300. The motion of ram 410 is relative to the position of frame 305. Therefore ram 410 forces pad 300 into a convex shape and transfer of droplets 215 from pad 300 to object 400 can commence. The amount of force required to deform pad 300 is determined by its thickness, extent, hardness, and the amount of deformation required. The radius of curvature and shape of ram 410 can range from flat to a small radius, depending on the material properties and dimensions of pad 300 and the shape of the surface being printed upon.

An optional illumination source 401 is arranged to illuminate droplets 215 with illumination of a predetermined wavelength from microwaves through ultraviolet. Optional heat, cold, gas, and humidity source 402 applies heat, cold, gas, and humidity to droplets 215 and pad 300. Sources 401 and 402 and their use are described below.

Operation—Preferred Embodiment—FIGS. 3 through 7

Inkjet head 209 is positioned beneath pad 300, as shown in FIG. 3. An image comprising ink droplets 215 is sprayed onto surface 302 of pad 300. Multiple colors of droplets 215 can be used. Ram 410 deforms pad 300, as described above and as shown in FIG. 4. Object 400 is positioned beneath pad 300. Pad 300, ram 410, and frame 305 all move toward object 400, compressing pad 300 and ink droplets 215 (not visible in this view) against object 400, as shown in FIG. 5. As in the case of the prior art print system described above, this force is typically between 0.2 and 50 kilograms.

Subsequently, as shown in FIG. 6, pad 300, ram 410, and frame 305 all move away from object 400, leaving behind an image 216 comprising now-transferred droplets 215 on object 400. Finally, as shown in FIG. 7, ram 410 is removed from pad 300, allowing pad 300 to return to its initial flat shape. At this time, pad 300 may be cleaned by a cleaning mechanism (not shown), as required. Pad 300 is now ready to receive and transfer another image, as shown in FIGS. 3 through 7.

The ink in image 216 can cure, or become permanent by any of a variety of means, such as evaporation or catalysis or by exposure to ultraviolet radiation, microwaves, visible light, infrared radiation, hot air, heat, cold, or moisture such as water or solvent vapor. At the present time, we prefer ultraviolet radiation.

Optionally, droplets 215 can be partially cured after deposition on surface 302 of pad 300 prior to transfer. This can be done by evaporation of solvent, catalysis, exposure to heat, moisture, or cold from source 402, or illumination, including microwaves, supplied by an illumination source 401 (FIG. 4). Illumination supplied by source 401 comprises predetermined wavelengths from infrared (IR, wavelengths longer than 900 nm) through ultraviolet (UV, wavelengths shorter than 400 nm), or microwaves (wavelengths on the order of 1 cm). Partial curing renders droplets 215 tacky, thus improving transfer from surface 302 of pad 300 to object 400.

Most inkjet printers in use today are capable of printing multiple colors using only one print head assembly. The ability to form a complete, multi-color image comprising droplets 215 on pad 300 permits single-pad, single transfer printing of a multi-color image. Thus no alignment of serially-applied pads is required. This results in a considerable saving of time and expense in printing the image. Further, the pad is reusable, and each succeeding image can be different. This makes possible pad printing of individual serial numbers, barcodes, legends, and the like on products, for example.

Figure 8:
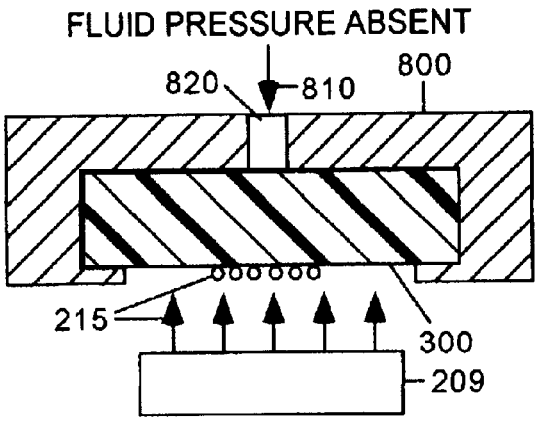
FIGS. 8 and 9 show an alternative embodiment.
Figure 9:
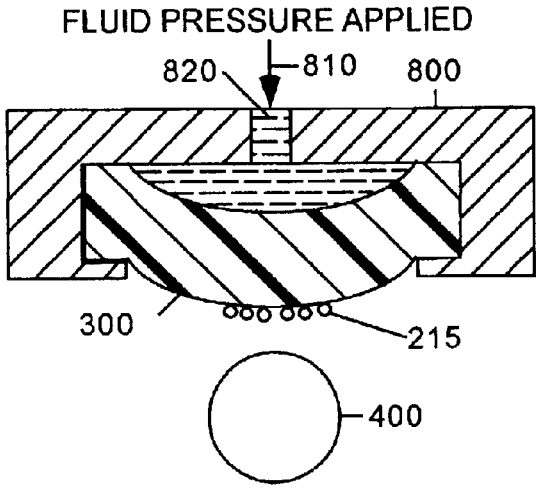

Description and Operation—Alternative Embodiment—FIGS. 8 Through 9

Instead of ram 410, shown in FIGS. 3 through 7, pad 300 can be deformed using hydraulic or pneumatic means. To do this, pad 300 is sealed within frame 800, as shown in FIG. 8. Fluid 810 is forced through port 820 at a nominal gauge pressure of roughly 4 bar and presses against the back side of pad 300, forcing pad 300 to bulge, as shown in FIG. 9. The curvature of pad 300 can be adjusted by varying the pressure in fluid 810. Ink 215 can now be transferred to object 400, as described above. After the transfer step, the pressure forcing fluid 810 is removed from the back side of pad 300, allowing it to return to the flat shape shown in FIG. 8. If required, a vacuum can be drawn through port 820 to assist in flattening pad 300. At this time, pad 300 can be cleaned, if necessary, and a new image applied by print head 209.

Figure 10:
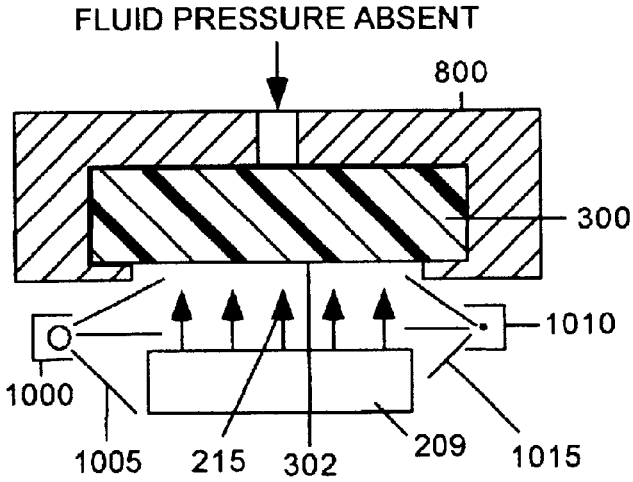
FIG. 10 shows a second alternative embodiment.

Description and Operation—Second Alternative Embodiment—FIG. 10

Alternative means can be used to prevent accumulation of static charge on the surface of pad 300. In this case, pad 300 can be made from an insulating rubber. Ionizing means can be applied to the air in the vicinity of pad 300. A radioactive source 1000, such as the element Americium 241, emits radiation 1005 which ionizes the air in its vicinity in well-known fashion. An abundance of positively and negatively-charged air ions circulate in this region. Electrical charges (not shown) which adhere to surface 302 of pad 300 attract charges of opposite polarity from the ionized air, thus becoming neutralized and removing the electric field between print head 209 and surface 302 of pad 300.

Alternatively, an alternating-current discharge 1010 can supply a mixture of positive and negative ions 1015 in the region between print head 209 and surface 302 of pad 300. Again, this abundance of charge of both polarities provides charges which neutralize any charge which has adhered to surface 302 of pad 300.

Another option is to provide high humidity in the air or gas surrounding pad 300. High humidity generally prevents the accumulation of static electric charges. Still another option is to provide an electrically conductive gas environment in surrounding pad 300. Gases of various types and humidity can be supplied through source 402, described above.

Figure 11:
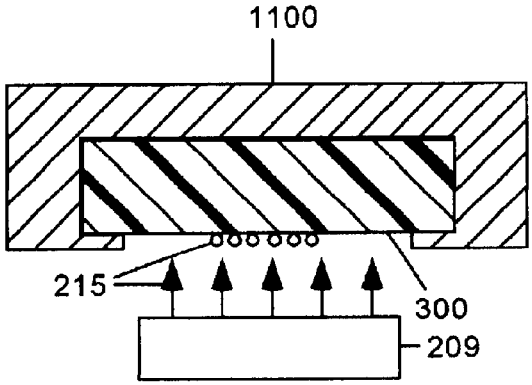
FIGS. 11 and 12 show a third alternative embodiment.
Figure 12:
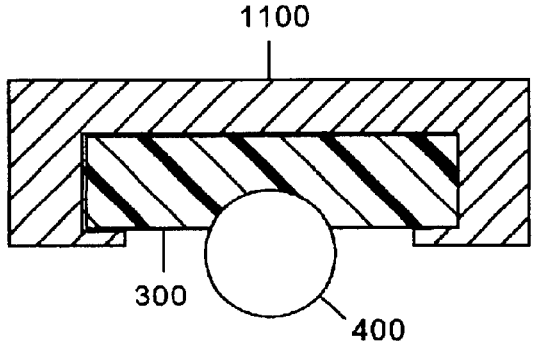

Operation—Third Alternative Embodiment—FIGS. 11–12

In some cases, it may be desirable to transfer ink droplets 215 from a flat pad, as shown in FIGS. 11 and 12. In this embodiment, pad 300 is held in frame 1100, and pad 300 remains flat at all times. In FIG. 11 ink 215 is applied to flat pad 300 as described above in connection with FIGS. 3 and 8. In FIG. 12, flat pad 300 is forced against object 400, transferring the image. This arrangement will be most useful in the case where object 400 is generally convex.

CONCLUSIONS, RAMIFICATIONS, AND SCOPE

Thus it is seen that we have provided a system which can print one or a plurality of colors on a flat pad, then transfer a complete image in a single transfer operation which does not require a cliché, photographic processing, or precise registration of multiple single-colored images, which is inexpensive, which requires minimal labor, and which results in fewer failed prints and less wasted time and materials.

While the above description contains many specificities, it will be apparent that the invention is not limited to these and can be practiced with other parameters and materials. A smooth or a textured pad surface can be used. Different shapes of pads, rams, and printed surfaces can be used. A piece of spring steel can be incorporated into the pad to urge the pad to return to a flat shape after transfer of an image. The pad surface can have various pre-determined affinities for the ink. Various surface energies will cause the ink droplets to either bead up or flatten out. The process variables including surface energies, wetting angles (well-known to those skilled in the art of printing), drying times, curing methods, and the like are determined by the individual application and surfaces to be printed.

Under some circumstances, an electric field can be applied between the conductive pad and the print head. If a uniform electric field is applied between these two elements, ink droplets can be made to fly straight from the ink jet assembly to their desired position in the image formed on the pad.

A perfect rendition of a flat image can be applied to a curved or irregular surface by pre-distorting the inkjet image to be transferred using computerized image-processing programs. Alternatively, an artistic effect can be obtained by deliberately distorting the final image.

Accordingly the scope of this invention should be determined, not by the embodiments illustrated, but by the appended claims and their legal equivalents.

We claim:

1. A system for pad printing, comprising:

a. a source containing ink of at least one color, b. a pad having a flat, non-patterned surface which is capable of being deformed from a flat shape into a convex shape, c. a printer connected to said source and capable of printing an image containing said ink from said source onto said flat surface of said pad, and d. a receiving surface for receiving said ink in said image from said pad, whereby said image can be printed onto said pad while said pad's surface is flat, and then said pad can be used to transfer said ink, while said pad's surface is deformed into a convex shape, onto said receiving surface.

2. The system of claim 1 wherein said ink is selected from the group consisting of water-based, solvent-based, oil-based, and wax-based inks.

3. The system of claim 1 wherein said printer is selected from the group consisting of offset, dye transfer, wax transfer, inkjet, and electrostatic printers.

4. The system of claim 1 wherein said ink is selected from the group consisting of frit, particle, metallic, magnetic, dye, or pigment-containing, ultra-violet curable, infrared-curable, light-curable, heat-curable, cold-curable, catalyst-curable, microwave-curable, and evaporating inks.

5. The system of claim 1 wherein said surface of said pad is smooth.

6. The system of claim 1 wherein said surface of said pad is textured.

7. The system of claim 1 wherein said receiving surface is selected from the group consisting of flat, curved, and irregular surfaces.

8. The system of claim 1 wherein said pad is electrically conductive.

9. The system of claim 1 wherein said pad is electrically conductive and is electrically connected to said source of ink.

10. The system of claim 1 wherein said pad is electrically insulative.

11. The system of claim 1 wherein said ink is partially cured while on said pad through the use of one or more modalities selected from the group consisting of evaporation, catalysis, moisture, heat, cold, and illumination.

12. The system of claim 1 wherein said pad is made of a material that can be reused so that subsequent versions of said image can be the same or different.

13. The system of claim 1 wherein said image can be printed onto said pad while said pad's surface is flat, and then said pad can be used to transfer said ink, while said pad's surface is flat, onto said receiving surface.

14. A method for pad printing, comprising:

providing a source containing ink of at least one color, providing a printer capable of printing an image comprising said ink and connected to said source, providing a deformable, non-patterned pad for receiving said image, a surface of said pad being flat, providing a receiving surface for receiving said image when transferred from said pad, printing said image from said printer onto said flat surface of said pad, deforming said pad into a convex shape, and transferring said image from said surface of said pad onto said receiving surface by pressing said pad against said receiving surface, whereby said image is printed onto said pad while said pad is flat, and then transferred to said receiving surface by said pad while said pad has a convex shape.

15. The method of claim 14 wherein said ink is selected from the group consisting of water-based, solvent-based, oil-based, and wax-based inks.

16. The method of claim 14 wherein said printer is selected from the group consisting of offset, dye transfer, wax transfer, inkjet, and electrostatic printers.

17. The method of claim 14 wherein said ink is selected from the group consisting of frit, particle, metallic, magnetic, dye, or pigment-containing, ultra-violet curable, infrared-curable, light-curable, heat-curable, cold-curable, catalyst-curable, microwave-curable, and evaporating inks.

18. The method of claim 14 wherein said surface of said pad is smooth.

19. The method of claim 14 wherein said surface of said pad is textured.

20. The method of claim 14 wherein said receiving surface is selected from the group consisting of flat, curved, and irregular surfaces.

21. The method of claim 14 wherein said pad is electrically conductive.

22. The method of claim 14 wherein said pad is electrically conductive and is electrically connected to said source of ink.

23. The method of claim 14 wherein said pad is electrically insulative.

24. The method of claim 14, further including partially curing said ink while on said pad through the use of one or more modalities selected from the group consisting of evaporation, catalysis, heat, cold, moisture, and illumination.

25. The method of claim 14 wherein said pad comprises a material that can be used and the process is repeated with another image.

26. The method of claim 14 wherein said image is printed onto said pad while said pad is flat, and then transferred to said receiving surface by said pad while said pad is flat.

27. A deformable pad and deformer for pad printing, comprising;

a. a source containing ink of at least one color, b. a flexible pad body of an elastomer having a flat, non-patterned surface, c. a printer connected to said source and capable of printing an image containing said ink from said source onto said flat surface of said pad, d. a frame means for holding said flexible pad body, e. deforming means for deforming said flexible pad body into a convex shape, whereby said pad can accept an image while flat and can print an image while deformed thereby avoiding entrapment of gas during printing.

28. The pad of claim 27 wherein the properties of said elastomer are selected from the group consisting of insulative, conductive, smooth, and rough.

* * * * *